United States Patent [19]

Stucker

[11] 4,027,799

[45] June 7, 1977

[54] V-BELT DISPLAY HOOK

[75] Inventor: Donald D. Stucker, Littleton, Colo.

[73] Assignee: The Gates Rubber Company, Denver, Colo.

[22] Filed: June 18, 1975

[21] Appl. No.: 587,926

[52] U.S. Cl. ..... 211/13; 211/59.1; 211/106; 248/220.3

[51] Int. Cl.[2] ..... A47F 5/08

[58] Field of Search ..... 211/13, 59, 87, 57; 248/DIG. 3, 219, 220.5

[56] References Cited

UNITED STATES PATENTS

| | | | |
|---|---|---|---|
| 1,387,454 | 8/1921 | Coleman | 248/DIG. 3 |
| 2,400,807 | 5/1946 | Borkhard | 248/DIG. 3 |
| 2,713,947 | 7/1955 | Foster | 211/13 |
| 2,872,145 | 2/1959 | Goldsholl | 248/DIG. 3 |
| 2,937,762 | 5/1960 | Deuter | 211/87 |
| 2,954,125 | 9/1960 | Husted | 248/DIG. 3 |
| 3,245,547 | 4/1966 | Felkay | 248/DIG. 3 |
| 3,645,485 | 2/1972 | Gold | 211/59 X |
| 3,973,678 | 8/1976 | Nesbitt | 211/181 X |

*Primary Examiner*—Roy D. Frazier
*Assistant Examiner*—Robert W. Gibson, Jr.
*Attorney, Agent, or Firm*—H. W. Oberg, Jr.; Raymond Fink; Curtis H. Castleman, Jr.

[57] ABSTRACT

A V-belt display support with a plurality of stepped fingers oriented in the same direction in generally an end-to-end manner, each hook capable of supporting at least one V-belt.

1 Claim, 3 Drawing Figures

V-BELT DISPLAY HOOK

BACKGROUND OF THE INVENTION

The invention relates to supports and racks, but more particularly, the invention relates to a display hook for supporting a plurality of V-belts.

V-belts are produced in a variety of widths and lengths to suit a multitude of applications. The belts are typically assorted by length and top width for quick assessability. A typical display rack for V-belts is disclosed in U.S. Pat. No. 2,400,807 as issued to Burkhard. While the prior art belts are adequate in terms of supporting and categorizing belts, they do not provide means for displaying a variety of belts in a minimum space with convenient assessability.

SUMMARY OF THE INVENTION

A V-belt display support is provided for displaying and categorizing a plurality of V-belts in a minimum space. The support has a frame member with means for attaching it to conventional gondolas or tandems as used by merchants. The frame member has a downwardly sloping mounting portion from which extend a plurality of U-shaped hooks with side portions or "fingers". The hooks are arranged with the side portions in stepped end-to-end relationship with the bottom of each hook secured to the frame member. One or more V-belts may be suspended from each hook. Indicia means are mounted to the hooks for belt categorization.

An advantage of the invention is that a plurality of different size belts may be displayed in a small space.

Another advantage of the invention is that different size belts are easily identifiable and removable from the support.

These and other advantages of the invention will be apparent after reviewing the drawings and description thereof wherein.

TECHNICAL DISCLOSURE

Figure 1:
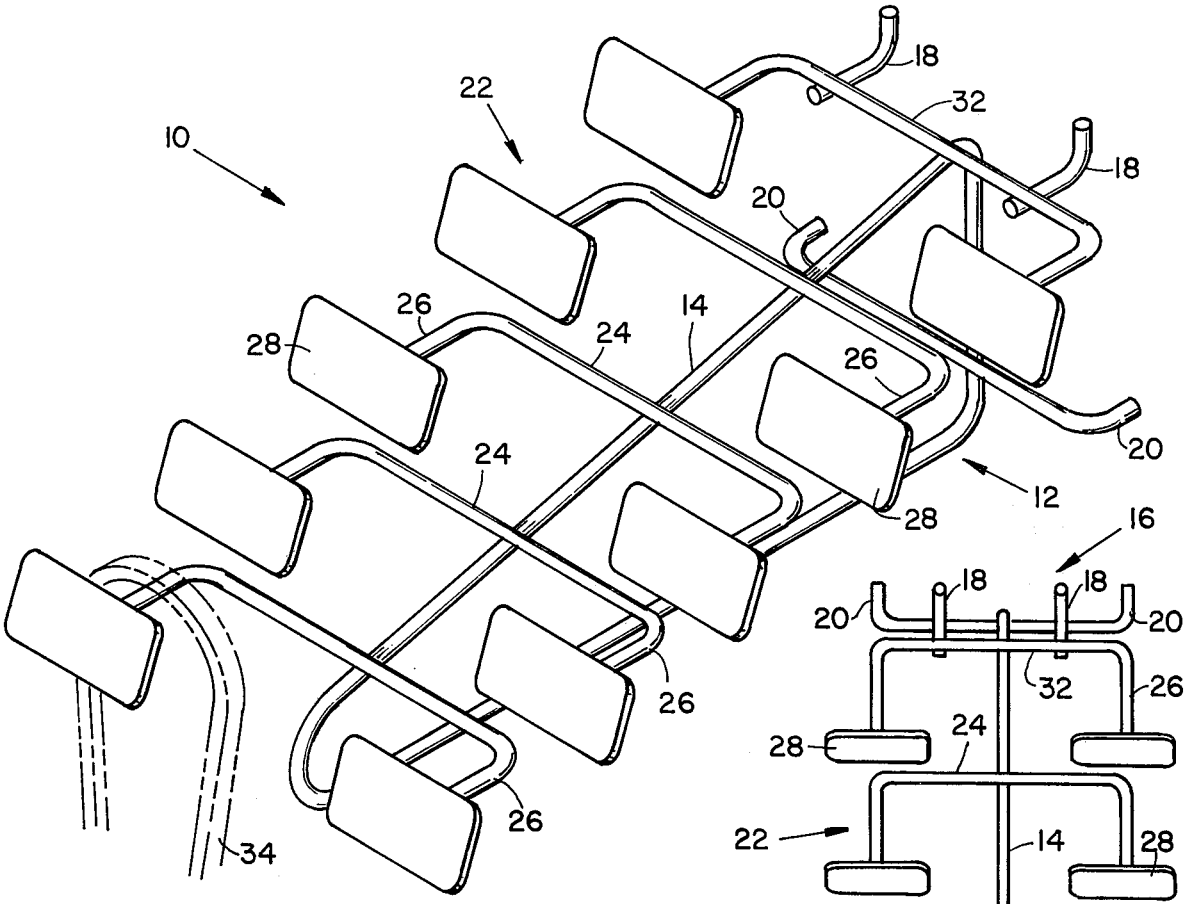
FIG. 1 is a perspective view of the support of the invention.
Figure 2:
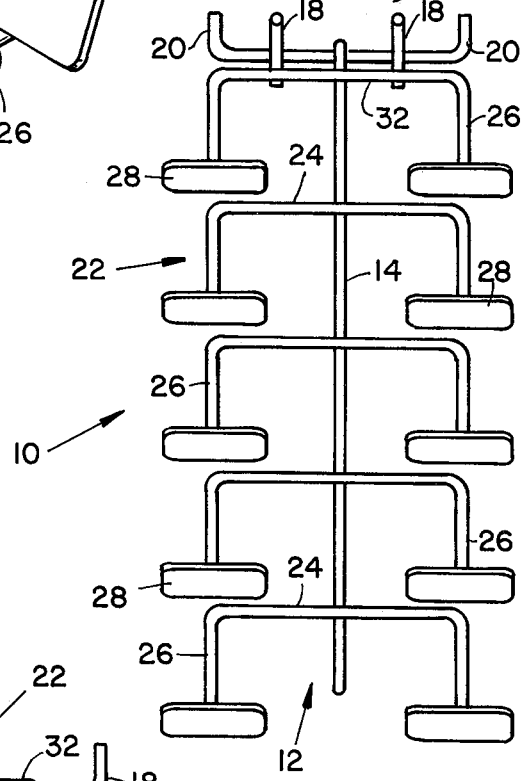
FIG. 2 is a top view of the support.

In accordance with the invention, a display support 10 is provided that includes a frame member 12 having a sloping mounting portion 14 and attachment means 16 for securing the support to secondary frame means such as gondolas, tandems or peg board.

In a preferred embodiment, spaced mounting hooks for peg board are used. The mounting hooks may be typical with two upwardly pointing hooks 18 for insertion into upper peg-board holes and two rearwardly pointing hooks 20 for insertion into lower peg-board holes. The hooks define the attachment means 16 for securing the frame member in a position that is generally normal to a secondary frame means. The mounting portion 14 of the frame member slopes downwardly as it extends forwardly of the secondary frame means.

Preferably, the frame member 12 is a wire formed in generally a triangular shape. Of course, other materials may be used provided a sloping mounting portion is included. For example, a planar wooden member having a sloping mounting portion could be used. Wire is preferred because of its light weight, strength, and ease of fabrication. End portions of the wire may be welded together and the attachment means may be easily welded to the frame member.

A plurality of generally U-shaped hooks 22 are secured to the sloping mounting portion of the frame member. Preferably, the hooks have substantially the same shape and size and are also of wire. The hooks may be easily attached by welding with their bottom portions 24 spaced and secured transversely of the frame member. The hooks are arranged so their leg portions 26 are oriented in substantially the same direction in a generally end-to-end manner with the leg portions 26 or fingers stepped in relation to each other.

The length of the leg portions 26, slope of the mounting portion 14, and spacing of the bottom portion 24, are such to define a space between successive hooks. The space is at least as large as the minimum dimension of a V-belt so that one or more V-belts may be positioned on the leg portions. Obviously, the spacing between the U-shaped hooks may be varied to accommodate different lengths of leg portions. Similarly, the sloping mounting portion may be stepped so that the vertical spacing between U-shaped hooks is varied. Also, the length of the bottom portion of the U-shaped hooks may be of different lengths to set the fingers away from the frame member so larger belts may be accommodated.

Figure 3:
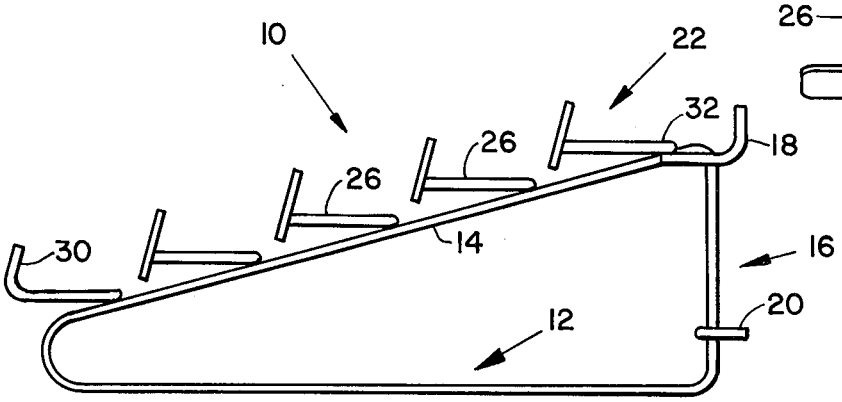
FIG. 3 is a side view of the support including a minor variation.

Preferably, flat plates 28 are secured to the ends of the leg portions 26 to define means for mounting belt indicia. The flat plates are sloped rearwardly so they may be easily viewed by an observer. Pressure sensitive tape may be adhered to the flat plates for belt indicia. Optionally, the ends of the leg portions may be bent upwardly 30 (FIG. 3) to define the mounting means. The mounting means may be used to retain belts in position on the hooks.

The most rearward U-shape hook 32 may be conveniently used in combination with the mounting hooks 18 for attaching the support to gondolas or tandems. Of course, other fasteners may be used such as screws, clips, rivets, etc. These are known means which need not be detailed here.

In use, one or more display supports are attached to a gondola, tandem, wall, or the like in a spaced relationship. One or more belts 34 of either the same or different size are positioned on the leg portions or fingers. When a U-shape hook with a bottom portion arranged substantially normal to the leg portions, the bottom portion prevents a belt from sliding rearwardly off or at a dissimilar position on the hooks. Similarly, the means for mounting belt indicia is preferably sufficiently large to keep the belts from sliding forwardly off the hooks. Thus, displayed belts are retained on the hooks until they are purposely removed. The sloping arrangement of the hooks advantageously permits easy access to all items displayed on the hooks. The sloping frame member also allows the belt indicia to be easily observed because the stepped relationship of the hooks and indicia mounting means provide an unobstructed view.

The foregoing detailed description is provided for purpose of illustration only and it is not intended to limit the scope of the invention which is to be determined from the appended claims.

What is claimed is:

1. A display support for V-belts comprising:

a frame member having a sloping mounting portion;

means for attaching the frame member to a secondary frame member;

a plurality of generally U-shaped hooks with bottom portions spaced and secured transversely of the mounting portion, so arranged that the leg portions of the hook project forwardly of and are laterally spaced from the mounting portion, and are oriented in the same direction and spaced generally end-to-end in generally spaced planes whereby the legs are stepped in relation to each other; and means for mounting belt indicia to the leg portions of each hook, said means comprising a plurality of generally flat plates, one plate attached to the forwardly projecting end of each leg portion.

* * * * *